United States Patent [19]

Guy

[11] 4,358,178

[45] Nov. 9, 1982

[54] HOOD FOR MULTICONTACT CONNECTOR

[75] Inventor: Rodney J. Guy, Boulder, Colo.

[73] Assignee: Western Electric Company, Inc., New York, N.Y.

[21] Appl. No.: 222,425

[22] Filed: Jan. 5, 1981

[51] Int. Cl.[3] ..... H01R 13/506

[52] U.S. Cl. ..... 339/103 R; 339/107; 339/141

[58] Field of Search ..... 339/103 R, 103 M, 107, 339/105, 196 R, 196 A, 196 M, 206 R, 208, 141

[56] References Cited

U.S. PATENT DOCUMENTS

| | | | |
|---|---|---|---|
| 2,209,814 | 7/1940 | Finger | 339/105 |
| 3,629,803 | 12/1971 | Gluntz | 339/107 |
| 3,794,960 | 2/1974 | Sugar | 339/107 |
| 3,936,129 | 2/1976 | Guy | 339/103 R |
| 3,999,830 | 12/1976 | Herrmann, Jr. et al. | 339/141 |
| 4,035,051 | 7/1977 | Guy | 339/103 R |
| 4,080,038 | 3/1978 | Latta et al. | 339/103 M |
| 4,108,527 | 8/1978 | Douty et al. | 339/107 |
| 4,125,312 | 11/1978 | Aimar | 339/107 |
| 4,180,304 | 12/1979 | Lerude | 339/196 M |
| 4,226,491 | 10/1980 | Kazama et al. | 339/17 LM |

FOREIGN PATENT DOCUMENTS 2827272 1/1979 Fed. Rep. of Germany ..... 339/107

*Primary Examiner*—Neil Abrams

*Attorney, Agent, or Firm*—J. J. Jordan

[57] ABSTRACT

A hood (10) is arranged for partially enclosing a terminal plug (14) onto which a plurality of electrical conductors have been terminated, which hood can be assembled onto the plug without the use of screws or other mounting apparatus even after the electrical conductors have been terminated. The hood comprises two half-shells (11–12) which are arranged to securely mount the plug-in channels (25, 45) located on the inside surfaces of walls of the half-shells. As the two half-shells are mounted on the plug, fastening means (51, 61, 81, 82) located on each of the half-shells mate with each other to securely lock the half-shells together to form hood 10 with terminal plug (14) seated within the assembled hood. Cable tie means (90, 92) are also disclosed for tieing the plurality of conductors (15) to one of the half-shells.

2 Claims, 7 Drawing Figures

HOOD FOR MULTICONTACT CONNECTOR

TECHNICAL FIELD

This invention relates to a hood for multicontact connectors, and more specifically to a hood which is economical to manufacture, easy to assemble securely to a connector and can be assembled on the connector regardless of when the cable has been terminated on the connector.

DESCRIPTION OF THE PRIOR ART

Multicontact connectors have enjoyed wide use in the telephone industry for terminating the conductors of multi-conductor cables. A typical connector comprises a terminal member, either a male plug or a female receptacle, which has terminated on its back side the individual conductors of the cable (usually 25 pairs of 26 gauge or 24 gauge copper wire) at preselected positions on the plug by means of soldering or clinching a conductor at each position. The other side of the plug, the front side, has a plurality of metal strips, each of which is electrically connected to a preselected position on the back side of the plug, for effecting a contact with strips on the front side of another connector plug with which it is physically brought into contact.

In order to protect the conductor terminations on the back side of the connector plug a hood is placed over the back side and affixed to the plug. Such protective hoods can be formed out of metal or plastic with suitable fastening means, such as screws, being used to securely fasten the hood to the plug. The hood also usually comprises means for securely gripping the jacket of the cable terminated by the connector plug to prevent forces imparted along the axis of the cable from tearing the terminated conductors away from the connector plug.

In the past, such protective hoods have often been formed out of single piece steel or molded plastic having means for accepting screws or having slotted tabs for securely fastening the associated plug to the hood. Other hoods have combinations of tabs at one end of the hood whih fit into slots on the plug and arrangements for securely tieing the cable jacket to the other end of the hood to securely fasten the plug to the hood and cable. An example of this type of hood is that disclosed in R. J. Guy, U.S. Pat. No. 3,936,129 assigned to the same assignee as the present invention. The disclosed hood is attached to the connector plug by a pair of slotted retainer tabs and by a snap type button tab which snaps into an aligned aperture on the plug. After the plug and hood have been aligned and the button tab snapped into position, the hood is clamped to the cable jacket by means of a cable tie, thereby permamently attaching the connector plug to the hood. A problem arises, however, when the wiring connections on the plug have to be changed because of mistakes, shorts, etc. With the present hood arrangements it is difficult, if not impossible, to remove the hood from an assembled connector in order to repair or rearrange connections on the plug without damaging the hood.

Still other types of hoods commonly called "center entrance" hoods are single pieces of molded plastic or metal having an aperture at its top for the associated cable to enter the hood. In using this type of hood, the craftsperson must be careful to pull the associated cable through the hole in the hood before the conductors on the cable are connected to the connector plug. If this is not done, the hood cannot be squeezed over the connected plug and the connections must be opened and the plug removed so that the hood can be fitted on to the cable. Additionally, center entrance hoods require screws or spring clips to clamp the terminal plug to the hood.

SUMMARY OF THE INVENTION

It is an object of the present invention to provide a connector hood for protecting the connector terminations on a terminal member and for securely seating the member within the hood without the use of screws or other mounting apparatus.

Another object is to provide a connector hood which can be easily assembled onto a terminal member after the wire conductors have been terminated on the plug.

A further object is to provide a connector hood which can be easily opened to permit the repair or rewiring of the associated terminal member without damaging the connector hood or plug.

A still further object is to provide a connector hood having means to securely clamp the hood onto a cable terminated at the connector terminal plug with the plug securely seated within the hood.

A connector hood in accordance with certain features of the invention is designed for protecting a plurality of leads terminated in a connector which is securely seated within the hood. The hood comprises two half sections, which when fitted together form a mounting cavity shaped to enclose the ends of the leads terminated in the connector. The half sections have a mounting means formed on their inner walls shaped to accept and receive a portion of the connector for mounting the connector within the half sections. The half sections are also provided with fastening means formed along facing edges of the half sections for locking the half sections together to form a connector hood around the connector seated within the assembled hood.

In a preferred embodiment, the mounting means includes a pair of longitudinal channels formed along the inner walls of the half sections and adapted for slidably receiving an outwardly extending ridge portion of the connector so as to mount the connector with the half sections upon assembly of the hood.

Preferably, securing means comprising a tie cable are used to secure the terminated cable to one of the half shells.

Other objects, specific advantages and features of the invention will be apparent from the following detailed description of specific examples and embodiments thereof, when read in conjunction with the accompanying drawings.

DETAILED DESCRIPTION

Figure 1:
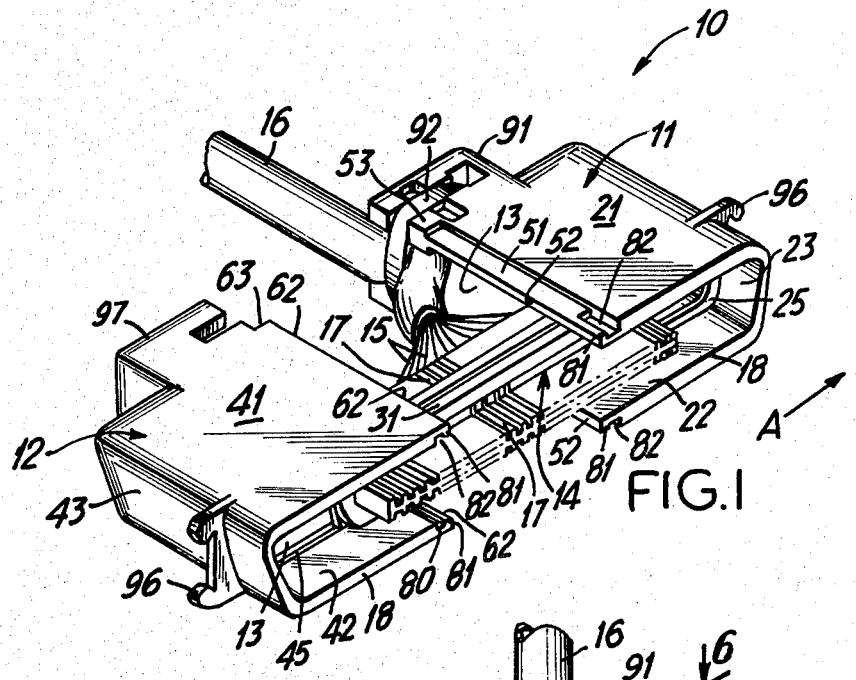
FIG. 1 is a perspective view of the connector hood with the two half-shells open to show a terminal member having fanned out conductors terminated on the plug.
Figure 2:
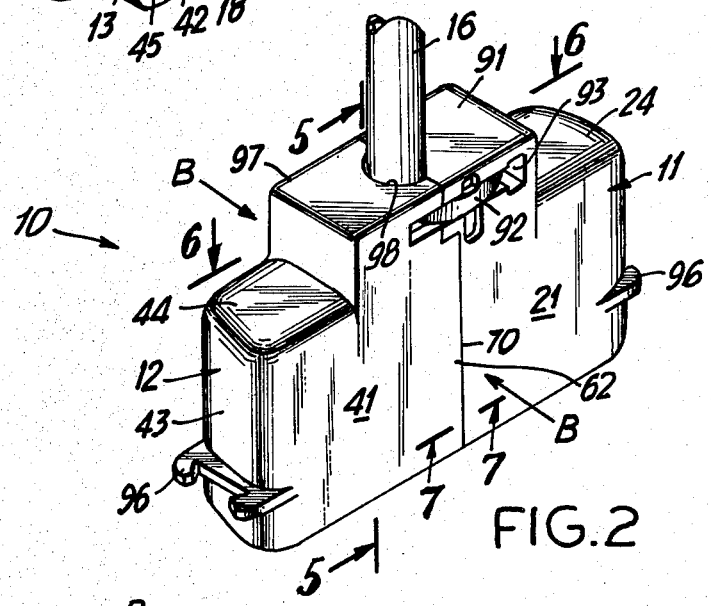
FIG. 2 is a perspective view of an assembled, closed connector hood.

Referring to FIGS. 1 and 2, there is shown a protective hood 10 comprising two portions, or half sections or half-shells 11–12, arranged to define a cavity 13 which fits over a connector terminal member, in this instance a male plug 14, onto which are terminated a plurality of conductors 15 extending from one end of a jacketed cable 16 to be interconnected by the plug 14 to other equipment. A female connector receptacle may be shown instead of the male temrinal plug 14. Preferably hood 10 is made of a semirigid dielectric plastic material, such as NORYL 990 manufactured by General Electric Co. Typically, terminal plug 14 has a plurlity of spaced parallel terminals 17 to which the conductors 15 are individually terminated. The terminals are arranged in one or more linear arrays and conductors 15 are fanned out within the cavity 13 for termination of each terminal 17 at its back end by either soldered or solderless assembly techniques. The front end of each terminal 17 projects out on plug 14 for electrical contact with other jacks with which it may be brought into physical contact. A terminal plug 14 of this type is manufactured by the Amphenol Corporation of Chicago, Ill.

The two half-shells 11–12 are arranged to snap into locked relationship with each other and to securely hold or seat terminal plug 14 during the assembly of hood 10 as seen in FIG. 2. Half-shell 11, which is substantially U-shaped as viewed from the lower edge, or bottom 18, of hood 10 (best seen in FIG. 3) and comprises parallel side walls 21 and 22 and a rear wall 23 which merge into an upper wall 24, is dimensioned such that parallel side walls 21 and 22 and rear wall 23 define half of cavity 13 for accommodating a portion of terminal plug 14 and terminated cable 16 which are inserted therein as seen in FIGS. 1, 3, 4 and 5.

Figure 4:
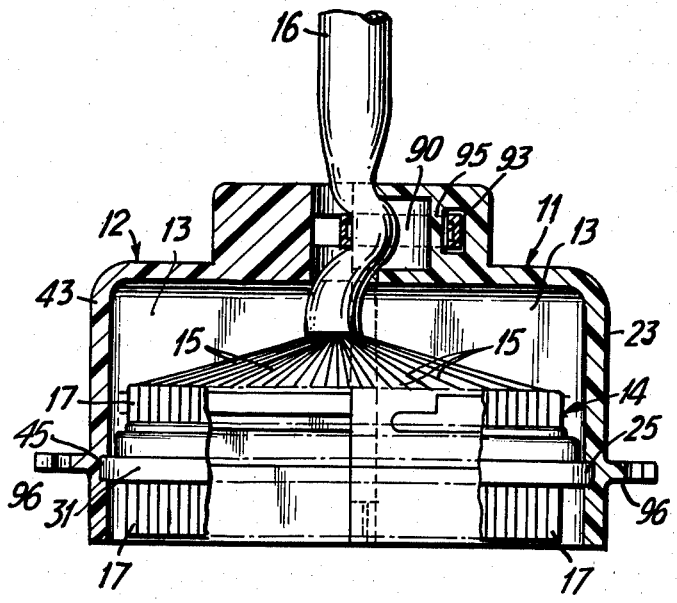
FIG. 4 is a cross sectional view taken along line 4—4 of FIG. 3 and shows the terminal plug seated within the assembled connector hood.
Figure 5:
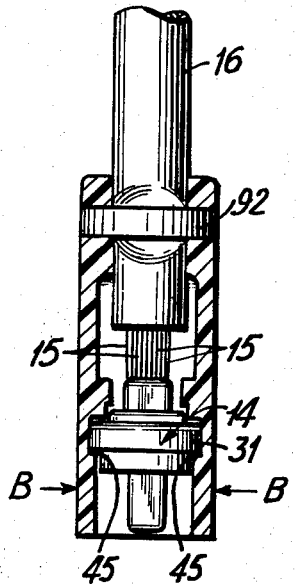
FIG. 5 is a cross sectional view taken along line 5—5 of FIG. 2 showing the terminal plug seated within the hood with the lower lips of the hood protecting the terminal plug.

A longitudinal groove, or channel 25, is formed along the inner surfaces of the walls 21, 22 and 23 for slidably receiving and seating an outwardly extending longitudinal ridge, or flange 31, of terminal plug 14 when the plug 14 is inserted into half-shell 11. The flange 31 is part of a molded plastic support or base member of the plug 14, and extends around the periphery of the plug 14 as seen in FIGS. 4 and 5. Channel 25 has a sufficient depth and width to securely mount the plug 14 within half-shell 11 in a predetermined position from front-to-rear in FIG. 1 when the half-shell 11 is assembled with the right end of the plug as indicated by arrow A in FIG. 1. In this example, the channel 25 is located at a sufficient distance from the front edge 18 of hood 10 that the front face of the plug 14 is slightly recessed from the front face of the shell 11 as shown in FIGS. 4 and 5, and so that the front ends of the terminals 17 are protected by the shell 11 when the plug 14 is properly seated within the half-shell 11.

Half-shell 12 of protective hood 10, having the same general U-shaped physical appearance as half-shell 11 described above, comprises two parallel side walls 41 and 42 and a rear wall 43 which merge into an upper wall 44 to define the other half of cavity 13. A second longitudinal channel 45 extends along the inner surfaces of walls 41, 42 and 43 for securely mounting the left end of the flange 31 of terminal plug 14 within the half-shell 12 when the shell 12 is assembled over the left end of the plug 14 as illustrated in FIG. 1. The channel 45 is located such that it cooperates with channel 25 of half-shell 11 when the two half-shells are locked together as seen in FIG. 2 so as to securely mount the plug 14 in a predetermined position, from top to bottom in FIGS. 4–5, within the hood 10.

Lips are formed along the two facing edges of each half sections 11 and 12 which edges come into contact with each other during assembly of hood 10 for aiding in the mating of the two half shells. Half-shell 11 has lips 51—51 formed on edges 52—52, as seen in FIG. 1, by cutting away a portion of the outer surface of side walls 21–22 along almost the entire length of the edges 52 thus forming lips 51—51 along the inner surface of the walls. A cube shaped cap 53 is located on the top of each edge 52 to form a protective barrier to prevent peeling away of the joined lips when half-shells 11 and 12 are mated as seen in FIG. 2. Lips 61—61 of half-shell 12 are formed on the outside surface of side walls 41 and 42 by cutting away a portion of the inside surface of the walls along the length of edges 62—62. However, edges 62—62 of half-shell 12 are not the same length as corresponding edges 52—52 of half-shell 11 since a section 63 has been removed at the top of each edge 62 to accommodate caps 53 when half-shells 11–12 are joined together. The combined thickness of lips 51 and 61 are equal to the thickness of walls 21–22 and 41–42 such that when lips 51 and 61 overlap each other as seen in FIG. 2, a non-bulging seam 70 is formed on assembled hood 10.

Figure 3:
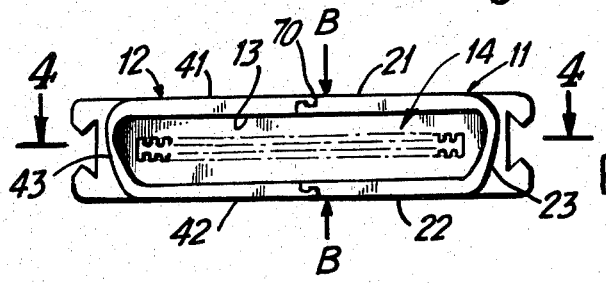
FIG. 3 is a bottom view of the connector hood shown in FIG. 2.
Figure 7:
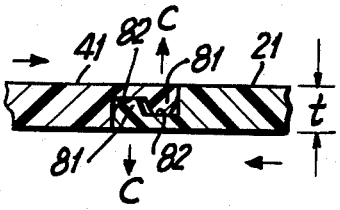
FIG. 7 is an enlarged fragmentary view taken along line 7—7 of FIG. 2 showing the interlocking means for fastening the two half-shell sections of the connector hood.

Extending in a perpendicular direction from and located at the bottom edge 18 of each lip 51–61 is fastening means which includes a tang 81 adjacent to a slot 82. Rectangular in shape, slots 82 on one half-shell are arranged to receive tangs 81 located on the opposite half-shell when half-shells 11 and 12 are joined together as seen in FIGS. 3 and 7. Tangs 81 and slots 82 are dimensionally equivalent on each half shell, the only difference between the tangs and slots on half-shell 11 as compared to those on half-shell 12 is that those on half-shell 11 face outwad while the ones on half-shell 12 face inward to permit mating of the two sets of tangs and slots as best seen in FIG. 3. Tangs 81 and slots 82 are sufficiently thick such that the combined thickness of a tang 81 captured by a slot 82 is no greater than the thickness of an associated wall 21–31 thereby assuring that the seam 70 between mated half-shells 11 and 12 is continuous with the surfaces of the mated half-shells as best seen in FIG. 7.

Slots 82 and tangs 83 extend upwardly on each lip 51–61 to a height which is no greater than the distance channels 25 and 45 are located above lower edge 18 of hood 10. The significance of this dimensional restraint will be explained below.

Any conventional cable securing means can be utilized to secure jacketed cable 16 to half-shell 11. In the presently disclosed arrangement, jacketed cable 16 is pressed alongside an arcuate shaped pressure pad 90 which is formed in an upper extension 91 of half-shell 11 as seen in FIGS. 1, 2, 4 and 6. A conventional self-locking tie cable 92 is inserted through an eyelet 93 which extends through upper extension 91 and around pressure pad 90 along the side opposite to which pressure pad 90 comes into contact with cable 16.

Figure 6:
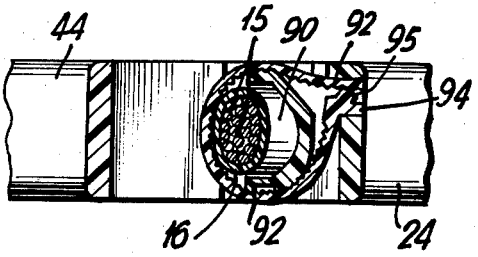
FIG. 6 is a fragmentary sectional view taken along line 6—6 of FIG. 2 showing the cable tie arrangement located in the top section of the hood.

A portion of upper extension 91 defining eyelet 93 serves as a stop 94 for head 95 of cable tie 92 such that cable 92 can be inserted into and pulled through eyelet 93 to be aligned in an engaging position with the back side of pressure pad 90 until head 95 is prevented from entering eyelet 93 by stop 94. Tie cable 92 is then wound around jacketed cable 16, pased through head 95 and tightened to permit cable tie 92 to being cable 16 in secure contact with the front side of pressure pad 90, as best seen in FIG. 6, for securely locking jacketed cable 16 in the upper extension 91 of half-shell 11.

Upper extension 97 on half-shell 12 comprises an arcuate section 98 for enclosing a portion of cable 16 when half-shell 12 mates with half-shell 11 as seen in FIG. 2.

Brackets 96 are shown on the outside surface of end walls 23 and 43 of half-shells 11 and 12 respectively, to accept a wire spring clip type of joining means which a female type connector receptacle may use when mating with male terminal plug 14 shown herein. Brackets 96 are not essential to the assembly or operation of hood 10, and are shown herein for illustrative purposes only.

To assembly hood 10 onto the terminal plug 14, the individual conductors 15 of cable 16 are fanned out from the cable and terminated at preselected terminals 17 of plug 14 as seen in FIG. 1. After this, flange 31 of plug 14 is aligned with and fitted into channel 25 of half-shell 11 and plug 14 is then pushed into half-shell 11 along channel 25 in the direction of arrow A of FIG. 1. With plug 14 fully seated into half-shell 11, self-locking tie cable 92 is inserted into and pulled through eyelet 93, wrapped around cable 16 and introduced into head 95 as described above. Prior to pulling self-locking tie cable 92 tight to securely lock cable 16 against pressure pad 90, an extra length, or a slack portion, of cable is fitted into and stored in cavity 13 as best seen in FIG. 4. The cable slack can be tucked into the cavity section of either half-shell 11 or 12, whichever is easier for the craftsperson to accomplish. Tie cable 92 is now tightened forcing cable 16 into secure contact with pressure pad 90. The additional length cable 16 stored in cavity 13 of half-shell 11 or 12 will permit terminal plug 14 to be pulled back out of half-shell 11 along channel 25 in the event any of the conductors 15 terminated on the end of plug 14 covered by half-shell 11 have to be reterminated.

Half-shell 12 is now placed on terminal plug 14 such that channel 45 fits over flange 31 of plug 14 and half-shell 12 is pushed toward half-shell 11 to fasten the two half-shells 11 and 12 together to form the hood 10.

As half-shell 12 approaches half-shell 11, lips 51–61 extending along edges 52–62 of half-shells 11 and 12 respectively make contact with each other; while tangs 81 on each of lips 51–61 also come into contact with each other. As further closing force is applied, the outer surface of lips 51 slide along the inner surface of lips 61 while tangs 81 located on half-shell 12 begin to ride up and along tangs 81 located on half-shell 11.

As half-shell 12 is pushed closer to half-shell 11, tangs 81 ride further along each other until they pass directly over associated slots 82 at which time tangs 81 snap into slots 82 and half-shell 12 is not mated with half-shell 11 to form hood 10 in which terminal plug 14 is securely seated. The molded plastic material is sufficiently resilient, and the wall thickness t (FIG. 7) of the shells is such that, as the tangs 81—81 approach each other when the half sections are assembled, the tangs cam each other apart (arrow C—C) sufficiently to clear each other, after which they snap back into the adjacent slots 82 so as to fasten the half sections together against longitudinal displacement, as illustrated in FIG. 7. To facilitate the camming action, the front faces of the tangs 81 are tapered so that the walls 21 and 41 can be cammed slightly apart on assembly. With the mating of the two half-shells, lips 51 and 61 fit over each other to form a non-bulging seam 70 on each side of hood 10 which seams 70 are each topped by cap 53 to prevent the inadvertent peeling away of seams 70 at the top of hood 10.

Mated half-shells 11 and 12, with upper extensions 91 and 97 enclosing cable 16, now form a hood 10 for protecting the conductor 15 terminations on seated terminal plug 14.

The assembled hood 10 and plug 14 provide structural support for each other in that channels 25 and 45 seat plug 14 while plug 14 provides the foundation on which half-shells 11 and 12 can be snapped together to form the hood. Thus the hood-plug structural combination is easy to assemble, and offers excellent protection for the electrical terminations on the plug without having to use screws or other mating apparatus to assemble the hood.

Hood 10 can be easily removed from terminal plug 14 without damaging the hood. By applying external force to half-shell 11 on walls 21 and 22 just above lower edge 18 and adjacent to seam 70 so as to pinch walls 21 and 22 together in the directions of arrows B in FIGS. 2, 3 and 5, tangs 81 can be disengaged from associated slots 82 such that half-shell 12 can now be pulled back along flange 31 and removed from terminal plug 14.

Tangs 81 are disengageable from associated slots 82 by the application of sufficient force on walls 21–22 because hood 10 is made of semirigid plastic which is flexible enough to permit the disengagement, and also because both tangs 81 and slots 82 do not extend up half-shells 11 and 12 beyond channels 25 and 45, as described above, and thus flange 31 of plug 14 seated in channels 25 and 45 does not prevent the required pinching movement.

After half-shell 12 is removed from plug 14, half-shell 11 can now be moved back off the remainder of plug 14 since the slack portion of cable 16 stored in cavity 13 permits such a movement. Half-shell 11 is still attached to cable 16 by tie cable 92 at upper portion 91 of the half-shell and half-shell 11 can be reinserted onto plug 14 along flange 31 at any time.

With the removal of half-shells 11 and 12 from terminal plug 14, terminals 17 are now fully open and conductors 15 can be repaired or reterminated as required.

If half-shell 11 can not be removed because insufficient slack cable has been stored in cavity 13 then tie cable 92 can be cut and half-shell 11 can now be easily removed. Later, after half-shell 11 has been properly fitted onto connector plug 14, a new tie cable 92 can be inserted into top portion 91 of half-shell 11 and wrapped around cable 16 to tie cable 16 to half-shell 11.

Thus hood 10 can be easily assembled onto plug 14 without the use of screws or other mounting apparatus and can be easily removed from plug 14 so that conductor terminations on the plug may be rewired as desired without damaging either hood 10 or plug 14.

While one specific example and embodiment of the invention has been described in detail hereinabove, it should be obvious that various modifications may be made from the specific details, steps and materials described without departing from the spirit and scope of the invention.

What is claimed is:

1. A protective hood for mounting and enclosing a connector terminal plug which terminates an electrical cable on a back end of the plug and which has a flange member, the hood being arranged to be easily mounted on and removed from the terminal plug, comprising:

(a) a pair of substantially indentical half-shells, each half-shell comprising:

(1) a hood portion having a connector plug opening at one end defined by walls for partially enclosing a portion of the connector plug;

(2) longitudinal channels formed along the inner surfaces of the walls of the shells for receiving the flange member of the plug so as to mount the plug in a predetermined position within the shell; and (3) protection means extending from the walls in a perpendicular direction away from the channels formed in the walls a sufficient distance to form a lower edge of the half-shell for protecting a portion of a front end of the terminal plug when the plug is mounted in the channels;

(b) resiliently engaging means located on the first half-shell comprising:

(1) lips extending along the edges of the walls of the half-shell which edges face the second half-shell when each half-shell has the plug mounted in the channels of the half-shell, the lips being formed by removing a portion of the outer surface of the wall at each of the edges; and (2) tangs and slots formed along the edges of the protection means of the half-shell between the lower edge of the half-shell and the channels, the tangs and slots facing toward the outer surface of the protective means; and (c) complimentary resiliently engaging means located on the second half-shell for accepting the resiliently engaging means of the first half-shell so as to easily snap fasten the half-shells together comprising:

(1) lips extending along the edges of the walls of the second half-shell which edges face the first half-shell, the lips being formed by removing a portion of the inner surface of the walls at each of the edges; and (2) tangs and slots formed along the edges of the protection means between the lower edge of the second half-shell and the channels, the tangs and slots facing toward the inner surface of the protection means and arranged such that the slots are positioned in the second half-shell to receive the tangs of the first half-shell and the tangs are positioned in the second half-shell to fit into the slots of the first half-shell;

such that when the first half-shell and second half-shell are mounted on the flange of the terminal plug and brought into contact with each other, the lips located on the edges of each half-shell slide along and overlap each other and the tangs and slots of each half-shell are engaged and easily snap into locking relationship with each other to form a nonbulging seam between the half-shells; and such that when the first and second half-shells are locked together, pressure applied to the first half-shell at points located just above the lower edge of the protection means and adjacent to the tangs and slots, and applied in directions so as to pinch the protection means together will disengage the tangs from the associated slots in the protection means to allow the second half-shell to be easily pulled back from the first half-shell to facilitate easy removal of the hood from the terminal plug.

2. A protective hood as recited in claim 1 further comprising means for securely fastening the electrical cable to the first half-shell.

* * * * *